US012467663B2

(12) United States Patent
Zhang et al.

(10) Patent No.: US 12,467,663 B2
(45) Date of Patent: Nov. 11, 2025

(54) HEAT PUMP SYSTEM AND CONTROL METHOD THEREOF

(71) Applicant: Carrier Corporation, Palm Beach Gardens, FL (US)

(72) Inventors: Yilin Zhang, Shanghai (CN); Weijuan Wang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 315 days.

(21) Appl. No.: 18/322,058

(22) Filed: May 23, 2023

(65) Prior Publication Data

US 2023/0384001 A1 Nov. 30, 2023

(30) Foreign Application Priority Data

May 24, 2022 (CN) ..... 202210568369.7

(51) Int. Cl.
*F25B 13/00* (2006.01)
*F25B 41/26* (2021.01)

(52) U.S. Cl.
CPC ..... *F25B 13/00* (2013.01); *F25B 41/26* (2021.01); *F25B 2600/2507* (2013.01)

(58) Field of Classification Search
CPC ..... F25B 13/00; F25B 41/26; F25B 41/20; F25B 41/30; F25B 41/31; F25B 2600/2509; F25B 2400/13
See application file for complete search history.

(56) References Cited

U.S. PATENT DOCUMENTS 7,137,270 B2 * 11/2006 Lifson ..... F25B 13/00 62/196.4
2013/0167559 A1 * 7/2013 Kim ..... F24D 5/12 62/324.6
2023/0175744 A1 * 6/2023 Nakajima ..... F25B 13/00 62/132

(Continued)

FOREIGN PATENT DOCUMENTS

JP H10148412 A 6/1998
JP 6072077 B2 2/2017
WO 2021200787 A1 10/2021

OTHER PUBLICATIONS

Extended European Search Report received for EP Application No. 23175164.5, mailed on Dec. 13, 2023, 8 Pages.

*Primary Examiner* — Miguel A Diaz
(74) *Attorney, Agent, or Firm* — Drew Folgmann

(57) ABSTRACT

A heat pump system comprises: a compressor having a compressor inlet and a compressor outlet; a change-over valve configured to selectively connect the compressor inlet and the compressor outlet to a first flow path and a second flow path; a heat-source-side heat exchanger on the first flow path; a user-side heat exchanger on the second flow path; a first branch and a second branch between the first flow path and the second flow path, the first branch having a three-way valve, and the second branch having a two throttling devices, wherein the three-way valve has two ports for communicating with the first flow path and a third port for communicating with the second flow path; and a third branch connected between the first throttling device and the second throttling device and the second port of the three-way valve, where an economizer is provided on the third branch.

17 Claims, 6 Drawing Sheets

(56) References Cited

U.S. PATENT DOCUMENTS

| | | | | |
|---|---|---|---|---|
| 2023/0235943 | A1* | 7/2023 | Shen | F25D 21/004<br>62/80 |
| 2024/0011671 | A1* | 1/2024 | Takegami | F25B 49/022 |

* cited by examiner

HEAT PUMP SYSTEM AND CONTROL METHOD THEREOF

CROSS REFERENCE TO RELATED APPLICATIONS

This application claims priority to Chinese Patent Application No. 202210568369.7 filed on May 24, 2022.

FIELD OF THE INVENTION

The present invention relates to the field of heat pumps, in particular to a heat pump system and a control method thereof.

BACKGROUND OF THE INVENTION

In order to improve the comfort of air-conditioning systems, the common air-conditioning systems have a heating mode. The air-conditioning systems with a cooling mode and a heating mode are also referred to as heat pump systems. In order to improve the heat pump system's capacity in the heating mode, an Enhanced Vapor Injection (EVI) compressor and an economizer located in front of a throttling device are often used, which can increase the system's heating capacity by about 10%.

In order to enable the EVI compressor and the economizer to also function in the cooling mode, i.e., to improve the system's capacity in the cooling mode, a complex pipeline structure with four check valves and one expansion valve is usually used, which challenges the reliability of the check valves.

SUMMARY OF THE INVENTION

According to a first aspect, a heat pump system is provided, comprising:

- a compressor having a compressor inlet and a compressor outlet;
- a change-over valve configured to selectively connect the compressor inlet and the compressor outlet to a first flow path and a second flow path;
- a heat-source-side heat exchanger on the first flow path;
- a user-side heat exchanger on the second flow path;
- a first branch and a second branch between the first flow path and the second flow path, the first branch being provided with a three-way valve, and the second branch being provided with a first throttling device and a second throttling device, wherein the three-way valve has a first port and a second port for communicating with the first flow path and a third port for communicating with the second flow path; and
- a third branch connected between a first position between the first throttling device and the second throttling device and the second port of the three-way valve, where an economizer is provided on the third branch.

Optionally, in an embodiment of the heat pump system, the compressor is an EVI compressor, the EVI compressor further comprises an air supply port, and the economizer comprises a port connected to the air supply port.

Optionally, in an embodiment of the heat pump system, the three-way valve is configured to only allow refrigerant to flow from its first port to its second port in a cooling mode, and to only allow refrigerant to flow from its third port to its second port in a heating mode.

Optionally, in an embodiment of the heat pump system, the first throttling device and the second throttling device are expansion valves.

Optionally, in an embodiment of the heat pump system, the heat pump system further comprises a controller for controlling the first throttling device and the second throttling device, wherein the controller is configured to turn off the first throttling device and allow the second throttling device to throttle in the cooling mode, and to turn off the second throttling device and allow the first throttling device to throttle in the heating mode.

Optionally, in an embodiment of the heat pump system, the three-way valve is a three-way stop valve, and the controller is configured to control the three-way valve such that the first and second ports of the three-way valve are turned on and the third port is turned off in the cooling mode, and the third and second ports of the three-way valve are turned on and the first port is turned off in the heating mode.

According to a second aspect, a control method of a heat pump system is provided, which is for use in a heat pump system according to the various embodiments, the method comprising: turning off the first throttling device and allowing the second throttling device to throttle in a cooling mode such that refrigerant passes through the first port of the three-way valve, the second port of the three-way valve, the economizer and the second throttling device in turn, and turning off the second throttling device and allowing the first throttling device to throttle in a heating mode such that refrigerant passes through the third port of the three-way valve, the second port of the three-way valve, the economizer and the first throttling device in turn.

According to a third aspect, a heat pump system is provided, comprising:

- a compressor having a compressor inlet and a compressor outlet;
- a change-over valve configured to selectively connect the compressor inlet and the compressor outlet to a first flow path and a second flow path;
- a heat-source-side heat exchanger on the first flow path;
- a user-side heat exchanger on the second flow path;
- a first three-way valve and a second three-way valve arranged in parallel between the first flow path and the second flow path, wherein the first three-way valve has a first port and a second port for communicating with the first flow path and a third port for connecting with the second flow path, and the second three-way valve has a first port and a second port for communicating with the first flow path and a third port for connecting with the second flow path; and
- an economizer and a throttling device connected in turn between the second port of the first three-way valve and the second port of the second three-way valve.

Optionally, in an embodiment of the heat pump system, the compressor is an EVI compressor, the EVI compressor further comprises an air supply port, and the economizer comprises a port connected to the air supply port.

Optionally, in an embodiment of the heat pump system, the first three-way valve is configured to only allow refrigerant to flow from its first port to its second port in a cooling mode and to only allow refrigerant to flow from its third port to its second port in a heating mode; the second three-way valves is configured to only allow refrigerant to flow from its second port to its third port in the cooling mode and to only allow refrigerant to flow from its second port to its first port in the heating mode.

Optionally, in an embodiment of the heat pump system, the throttling device is an expansion valve.

Optionally, in an embodiment of the heat pump system, the first three-way valve is a first three-way stop valve and the second three-way valve is a second three-way stop valve, wherein the heat pump system further comprises a controller for controlling the first three-way valve and the second three-way valve, such that the first and second ports of the first three-way valve are turned on and the third port of the first three-way valve is turned off, and the second and third ports of the second three-way valve are turned on and the first port of the second three-way valve is turned off in the cooling mode; and the second and third ports of the first three-way valve are turned on and the first port of the first three-way valve is turned off, and the first and second ports of the second three-way valve are turned on and the third port of the second three-way valve is turned off in the heating mode.

According to a fourth aspect, a control method of a heat pump system is provided, which is for use in a heat pump system according to the various embodiments, the method comprising:

turning on the first and second ports of the first three-way valve and turning off the third port of the first three-way valve, and turning on the second and third ports of the second three-way valve and turning off the first port of the second three-way valve in the cooling mode, such that refrigerant passes through the first port of the first three-way valve, the second port of the first three-way valve, the economizer, the throttling device, the second port of the second three-way valve and the third port of the second three-way valve in turn; and turning on the second and third ports of the first three-way valve and turning off the first port of the first three-way valve, and turning on the first and second ports of the second three-way valve and turning off the third port of the second three-way valve in the heating mode, such that refrigerant passes through the third port of the first three-way valve, the second port of the first three-way valve, the economizer, the throttling device, the second port of the second three-way valve and the first port of the second three-way valve in turn.

According to a fifth aspect, a heat pump system is provided, comprising:

a compressor having a compressor inlet and a compressor outlet;

a change-over valve configured to selectively connect the compressor inlet and the compressor outlet to a first flow path and a second flow path;

a heat-source-side heat exchanger on the first flow path;

a user-side heat exchanger on the second flow path;

a four-way valve arranged between the first flow path and the second flow path, wherein the four-way valve has a first port and a second port for communicating with the first flow path, and a third port and a fourth port for communicating with the second flow path; and an economizer and a throttling device connected in turn between the second port and the fourth port of the four-way valve.

Optionally, in an embodiment of the heat pump system, the compressor is an EVI compressor, the EVI compressor further comprises an air supply port, and the economizer comprises a port connected to the air supply port.

Optionally, in an embodiment of the heat pump system, the four-way valve is configured to only allow refrigerant to flow from its first port to its second port, and from its fourth port to its third port in the cooling mode, and to only allow refrigerant to flow from its third port to its second port, and from its fourth port to its first port in the heating mode.

Optionally, in an embodiment of the heat pump system, the throttling device is an expansion valve.

Optionally, in an embodiment of the heat pump system, the four-way valve is a four-way stop valve, and the heat pump system further comprises a controller for controlling the four-way valve, such that the first and second ports of the four-way valve are communicated and the third and fourth ports of the four-way valve are communicated in the cooling mode, and the first and fourth ports of the four-way valve are communicated and the second and third ports of the four-way valve are communicated in the heating mode.

According to a sixth aspect, a control method of a heat pump system is provided, which is for use in a heat pump system according to the various embodiments, the method comprising:

communicating the first and second ports of the four-way valve and communicating the third and fourth ports of the four-way valve in a cooling mode, such that refrigerant passes through the first port of the four-way valve, the second port of the four-way valve, the economizer, the throttling device, the fourth port of the four-way valve and the third port of the four-way valve in turn; and communicating the first and fourth ports of the four-way valve and communicating the second and third ports of the four-way valve in a heating mode, such that refrigerant passes through the third port of the four-way valve, the second port of the four-way valve, the economizer, the throttling device, the fourth port of the four-way valve and the first port of the four-way valve in turn.

A heat pump system and a control method thereof according to the embodiments of the present invention can be used in both cooling and heating modes. In addition, the use of multiple-way valves can improve the reliability of the heat pump system.

BRIEF DESCRIPTION OF THE DRAWINGS

With reference to the accompanying drawings, the disclosure of the present application will become easier to understand. Those skilled in the art would readily appreciate that these drawings are for the purpose of illustration, and are not intended to limit the protection scope of the present application. In addition, in the figures, similar numerals are used to denote similar components, where.

DETAILED DESCRIPTION OF EMBODIMENT(S) OF THE INVENTION

Figure 1:
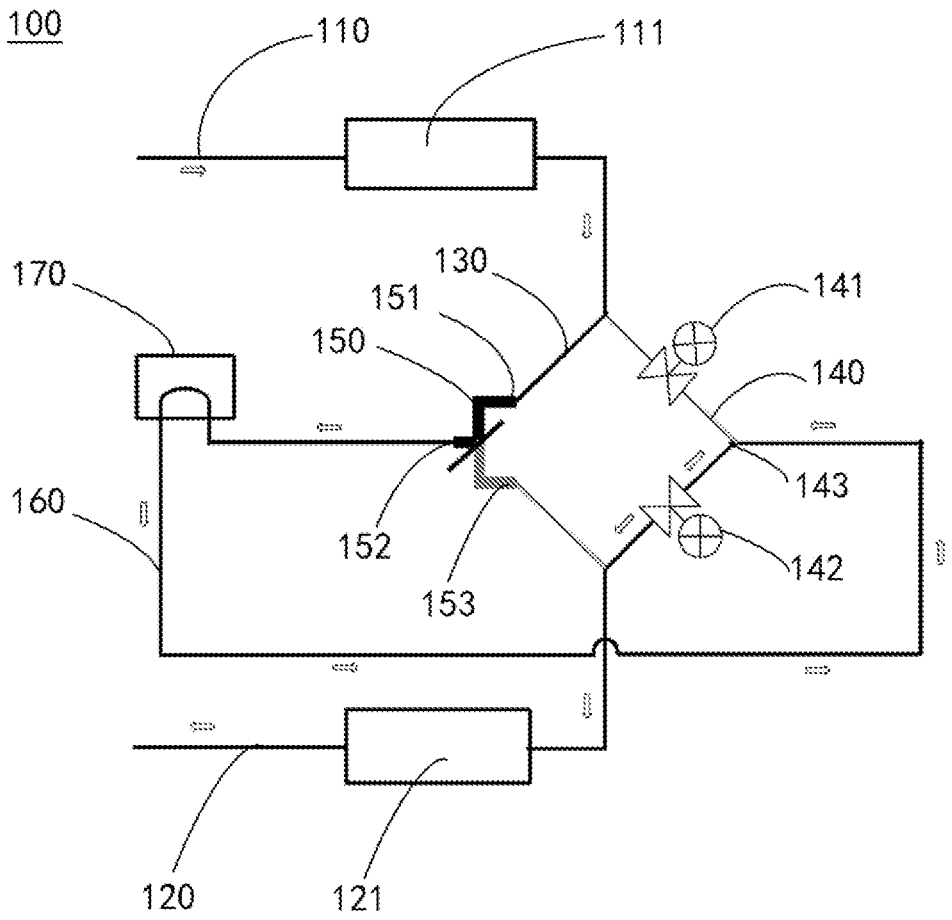
FIG. 1 shows a local schematic diagram of a first embodiment of a heat pump system according to the present invention in a cooling mode.

FIG. 1 shows a local schematic diagram of a heat pump system according to a first embodiment of the present invention. The heat pump system 100 comprises: a compressor (not shown) having a compressor inlet and a compressor outlet; a change-over valve (not shown) configured to selectively connect the compressor inlet and the compressor outlet to a first flow path 110 and a second flow path 120; a heat-source-side heat exchanger 111 on the first flow path 110; a user-side heat exchanger 121 on the second flow path 120; a first branch 130 and a second branch 140 between the first flow path 110 and the second flow path 120, the first branch 130 being provided with a three-way valve 150, and the second branch 140 being provided with a first throttling device 141 and a second throttling device 142, wherein the three-way valve 150 has a first port 151 and a second port 152 for communicating with the first flow path 110 and a third port 153 for communicating with the second flow path 120; and a third branch 160 connected between a first position 143 between the first throttling device 141 and the second throttling device 142, and the second port 152 of the three-way valve 150, wherein an economizer 170 is provided on the third branch 160. The heat pump system according to the embodiments of the present invention utilizes a three-way valve, a first throttling device and a second throttling device to realize the application of an economizer in the cooling and heating modes, thereby improving system capacity and stability. In addition, the use of three-way valve can improve system reliability.

In conjunction with other alternative embodiments in the above embodiments, the application of combining a heat pump system according to the embodiments of the present invention with an EVI compressor may be considered. The compressor is an Enhanced Vapor Injection (EVI) compressor, which includes not only the compressor inlet and the compressor outlet, but also an air supply port (not shown). The compressor is connected with the heat pump system part shown in FIG. 1 through a change-over valve, and the economizer 170 is also connected to the air supply port of the compressor. More specifically, the compressor outlet and the compressor inlet of the EVI compressor are selectively communicated with the first flow path 110 and the second flow path 120 via the change-over valve to execute the cooling and heating modes.

Figure 2:
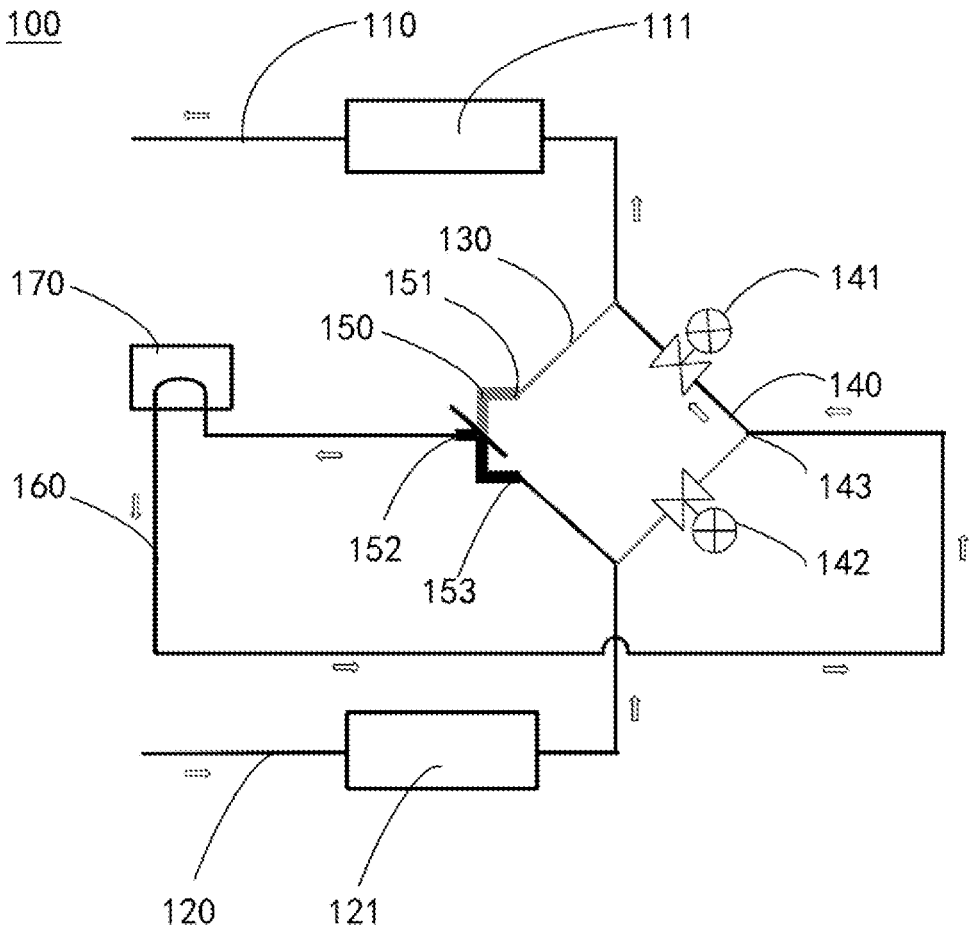
FIG. 2 shows a local schematic diagram of a first embodiment of a heat pump system according to the present invention in a heating mode.

In some embodiments, the three-way valve 150 is configured to only allow refrigerant to flow from its first port 151 to its second port 152 in the cooling mode (as shown in FIG. 1), and to only allow refrigerant to flow from its third port 153 to its second port 152 in the heating mode (as shown in FIG. 2). In some embodiments, the first throttling device 141 and the second throttling device 142 are expansion valves, such as electronic expansion valves. In some embodiments, the heat pump system further comprises a controller (not shown) for controlling the first throttling device 141 and the second throttling device 142. The controller is configured to turn off the first throttling device 141 and allow the second throttling device 142 to throttle in the cooling mode, and to turn off the second throttling device 142 and allow the first throttling device 141 to throttle in the heating mode. In some embodiments, the three-way valve 150 is a three-way stop valve. The controller is configured to control the three-way valve 150, such that the first port 151 and the second port 152 of the three-way valve 150 are turned on and the third port 153 of the three-way valve 150 is turned off in the cooling mode, and the third port 153 and the second port 152 of the three-way valve 150 are turned on and the first port 151 of the three-way valve 150 is turned off in the heating mode. In some embodiments, other suitable types of valves may also be used to achieve the above functions.

The heat pump system according to the embodiments of the present invention employs a three-way valve and two electronic expansion valves to realize the application of an economizer in the cooling and heating modes. Compared to the existing structure with four check valves and a single expansion valve, the number of valves is reduced, in particular the number of check valves with poor stability, which improves system stability.

According to another aspect, the embodiments of the present invention also provide a control method of a heat pump system, the method comprising: turning off the first throttling device 141 and allowing the second throttling device 142 to throttle in the cooling mode, such that refrigerant passes through the first port 151 of the three-way valve 150, the second port 152 of the three-way valve 150, the economizer 170 and the second throttling device 142 in turn, as shown by the arrows in FIG. 1; and turning off the second throttling device 142 and allowing the first throttling device 141 to throttle in the heating mode, such that refrigerant passes through the third port 153 of the three-way valve 150, the second port 152 of the three-way valve 150, the economizer 170 and the first throttling device 141 in turn, as shown by the arrows in FIG. 2. It can thus be seen that in the control method of a heat pump system according to the embodiment illustrated in FIGS. 1-2, the application of an economizer in the cooling and heating modes is realized through the use of a three-way valve and two throttling devices, thereby improving system efficiency and stability.

Figure 3:
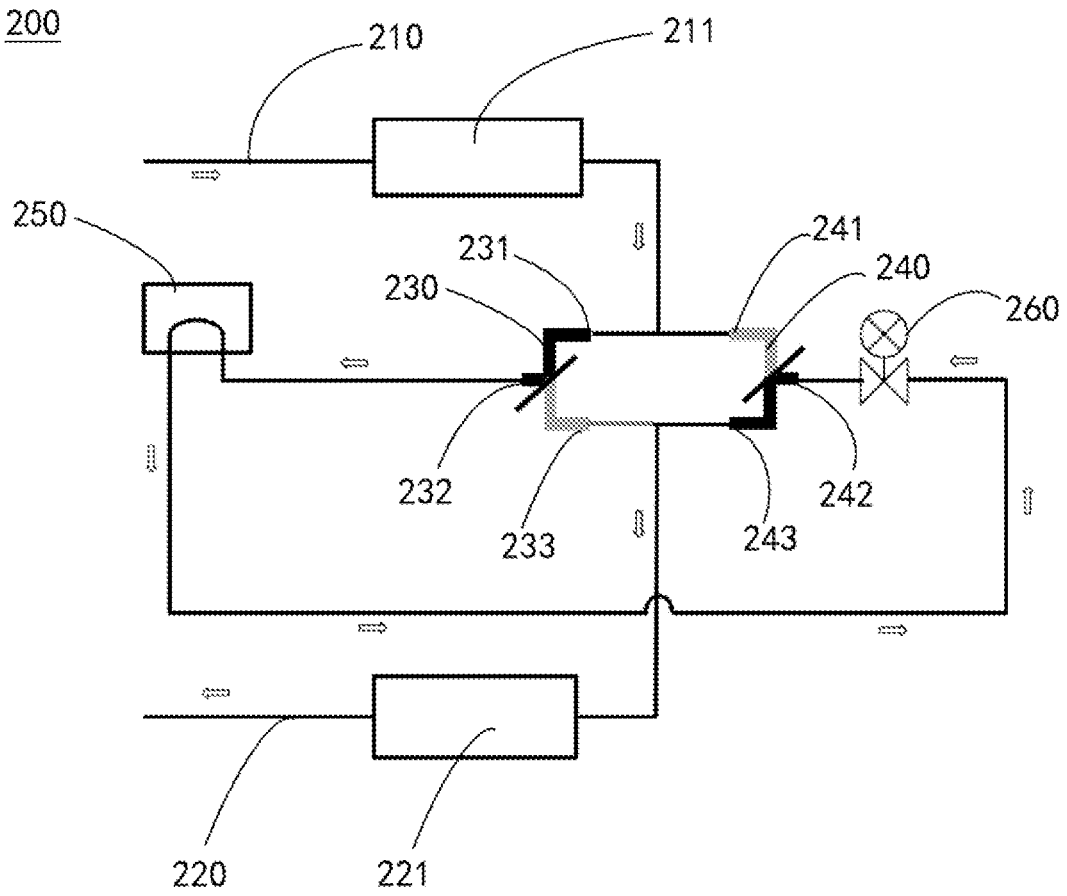
FIG. 3 shows a local schematic diagram of a second embodiment of a heat pump system according to the present invention in a cooling mode.

FIG. 3 shows a local schematic diagram of a heat pump system according to a second embodiment of the present invention. The heat pump system 200 comprises: a compressor (not shown) having a compressor inlet and a compressor outlet; a change-over valve (not shown) configured to selectively connect the compressor inlet and the compressor outlet to a first flow path 210 and a second flow path 220; a heat-source-side heat exchanger 211 on the first flow path 210; a user-side heat exchanger 221 on the second flow path 220; a first three-way valve 230 and a second three-way valve 240 arranged in parallel between the first flow path 210 and the second flow path 220, wherein the first three-way valve 230 has a first port 231 and a second port 232 for communicating with the first flow path 210 and a third port 233 for communicating with the second flow path 220, and the second three-way valve 240 has a first port 241 and a second port 242 for communicating with the first flow path 210, and a third port 243 for communicating with the second flow path 220; and an economizer 250 and a throttling device 260 connected in turn between the second port 232 of the first three-way valve 230 and the second port 242 of the second three-way valve 240. The heat pump system according to the embodiments of the present invention utilizes two three-way valves arranged in parallel and a throttling device to realize the application of an economizer in the cooling and heating modes, thereby improving system capacity and stability. In addition, the use of three-way valves can improve system reliability.

In conjunction with other alternative embodiments of the above embodiments, the application of combining a heat pump system according to the embodiments of the present invention with an EVI compressor may be considered. The compressor is an Enhanced Vapor Injection (EVI) compressor, which includes not only the compressor inlet and the compressor outlet, but also an air supply port (not shown). The compressor is connected with the heat pump system part shown in FIG. 3 through a change-over valve, and the economizer 250 is also connected to the air supply port of the compressor. More specifically, the compressor outlet and the compressor inlet of the EVI compressor are selectively communicated with the first flow path 210 and the second flow path 220 via the change-over valve to execute the cooling and heating modes.

Figure 4:
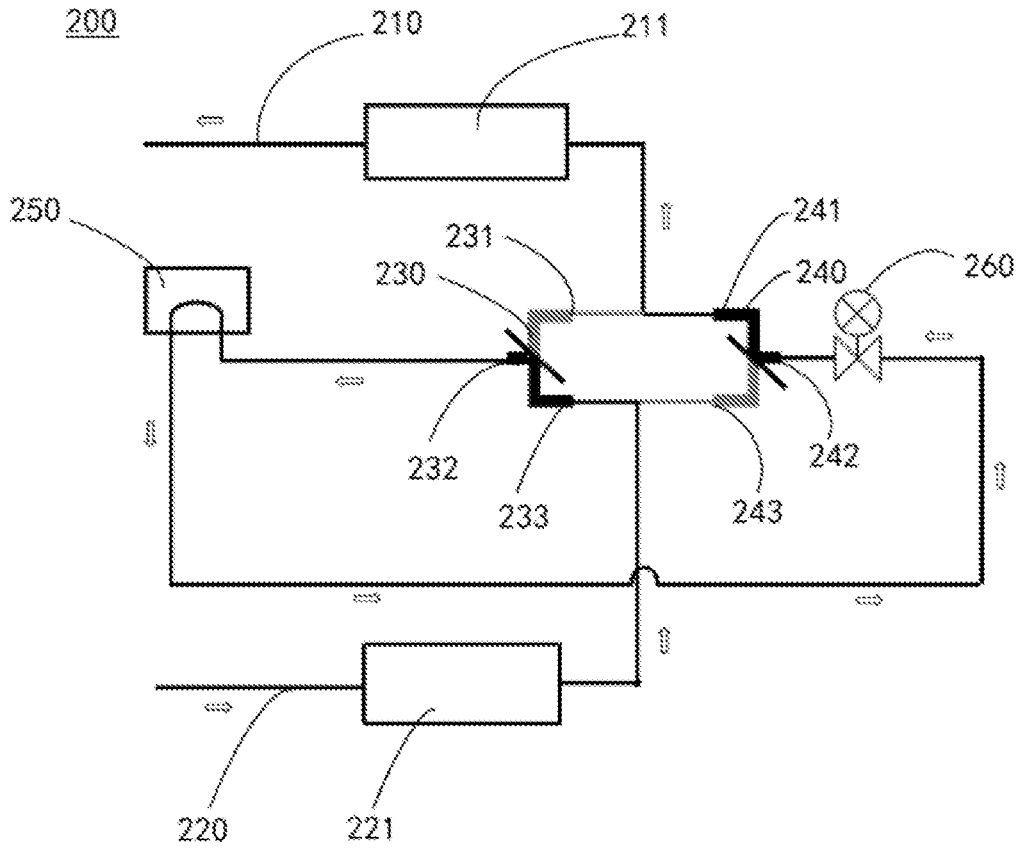
FIG. 4 shows a local schematic diagram of a second embodiment of a heat pump system according to the present invention in a heating mode.

In some embodiments, the first three-way valve 230 is configured to only allow refrigerant to flow from its first port 231 to its second port 232 in the cooling mode (as shown in FIG. 3), and to only allow refrigerant to flow from its third port 233 to its second port 232 in the heating mode (as shown in FIG. 4). The second three-way valve 240 is configured to only allow refrigerant to flow from its second port 242 to its third port 243 in the cooling mode (as shown in FIG. 3), and to only allow refrigerant to flow from its second port 242 to its first port 241 in the heating mode (as shown in FIG. 4). In some embodiments, the throttling device 260 is an expansion valve, such as an electronic expansion valve. In some embodiments, the first three-way valve 230 is a first three-way stop valve, and the second three-way valve 240 is a second three-way stop valve. Wherein, the heat pump system further comprises a controller (not shown) for controlling the first three-way valve 230 and the second three-way valve 240, such that the first port 231 and the second port 232 of the first three-way valve 230 are turned on and the third port 233 of the first three-way valve 230 is turned off, and the second port 242 and the third port 243 of the second three-way valve 240 are turned on and the first port 241 of the second three-way valve 240 is turned off in the cooling mode; and the second port 232 and the third port 233 of the first three-way valve 230 are turned on and the first port 231 of the first three-way valve 230 is turned off, and the first port 241 and the second port 242 of the second three-way valve 240 are turned on and the third port 243 of the second three-way valve 240 is turned off in the heating mode. In some embodiments, other suitable types of valves may also be used to achieve the above functions.

The heat pump system according to the embodiments of the present invention employs three-way valves arranged in parallel and an electronic expansion valve to realize the application of an economizer in the cooling and heating modes. Compared to the existing structure with four check valves and a single expansion valve, the number of valves is reduced, in particular the number of check valves with poor stability, which improves system stability.

According to another aspect, the embodiments of the present invention also provide a control method of a heat pump system, the method comprising: turning on the first port 231 and the second port 232 of the first three-way valve 230 and turning off the third port 233 of the first three-way valve 230, and turning on the second port 242 and the third port 243 of the second three-way valve 240 and turning off the first port 241 of the second three-way valve 240 in the cooling mode, such that refrigerant passes through the first port 231 of the first three-way valve 230, the second port 232 of the first three-way valve 230, the economizer 250, the throttling device 260, the second port 242 of the second three-way valve 240 and the third port 243 of the second three-way valve 240 in turn, as shown by the arrows in FIG. 3; and turning on the second port 232 and the third port 233 of the first three-way valve 230 and turning off the first port 231 of the first three-way valve 230, and turning on the first port 241 and the second port 242 of the second three-way valve 240 and turning off the third port 243 of the second three-way valve 240 in the heating mode, such that refrigerant passes through the third port 233 of the first three-way valve 230, the second port 232 of the first three-way valve 230, the economizer 250, the throttling device 260, the second port 242 of the second three-way valve 240 and the first port 241 of the second three-way valve 240 in turn, as shown by the arrows in FIG. 4. It can thus be seen that in the control method of a heat pump system according to the embodiment illustrated in FIGS. 3-4, the application of an economizer in the cooling and heating modes is realized through the use of three-way valves arranged in parallel and a throttling device, thereby improving system efficiency and stability.

Figure 5:
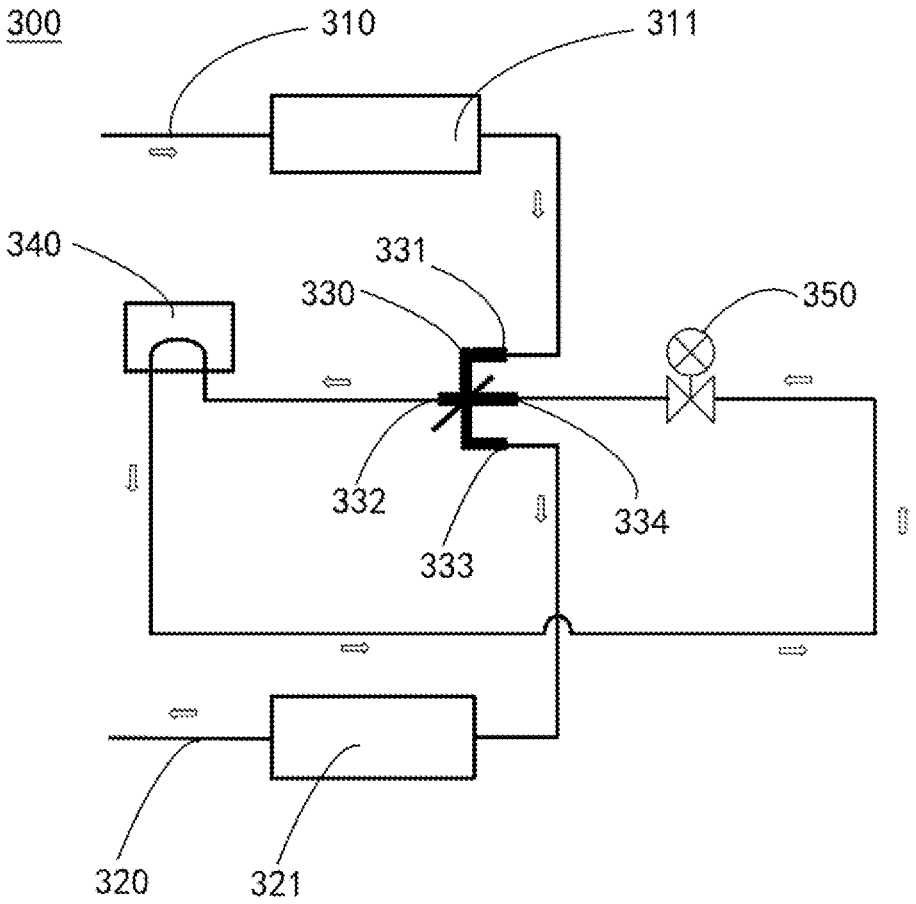
FIG. 5 shows a local schematic diagram of a third embodiment of a heat pump system according to the present invention in a cooling mode.

FIG. 5 shows a local schematic diagram of a heat pump system according to a third embodiment of the present invention. The heat pump system 300 comprises: a compressor (not shown) comprising a compressor inlet and a compressor outlet; a change-over valve (not shown) configured to selectively connect the compressor inlet and the compressor outlet to a first flow path 310 and a second flow path 320; a heat-source-side heat exchanger 311 on the first flow path 310; a user-side heat exchanger 321 on the second flow path 320; a four-way valve 330 arranged between the first flow path 310 and the second flow path 320, wherein the four-way valve 330 has a first port 331 and a second port 332 for communicating with the first flow path 310, and a third port 333 and a fourth port 334 for communicating with the second flow path 320; and an economizer 340 and a throttling device 350 connected in turn between the second port 332 and the fourth port 334 of the four-way valve 330. The heat pump system according to the embodiments of the present invention utilizes a four-way valve and a throttling device to realize the application of an economizer in the cooling and heating modes, thereby improving system capacity and stability. In addition, the use of the three-way valve can improve system reliability.

In conjunction with other alternative embodiments of the above embodiments, the application of combining a heat pump system according to the embodiments of the present invention with an EVI compressor may be considered. The compressor is an Enhanced Vapor Injection (EVI) compressor, which includes not only the compressor inlet and the compressor outlet, but also an air supply port (not shown). The compressor is connected with the heat pump system part shown in FIG. 5 through a change-over valve, and the economizer 340 is also connected to the air supply port of the compressor. More specifically, the compressor outlet and the compressor inlet of the EVI compressor are selectively communicated with the first flow path 310 and the second flow path 320 via the change-over valve to execute the cooling and heating modes.

Figure 6:
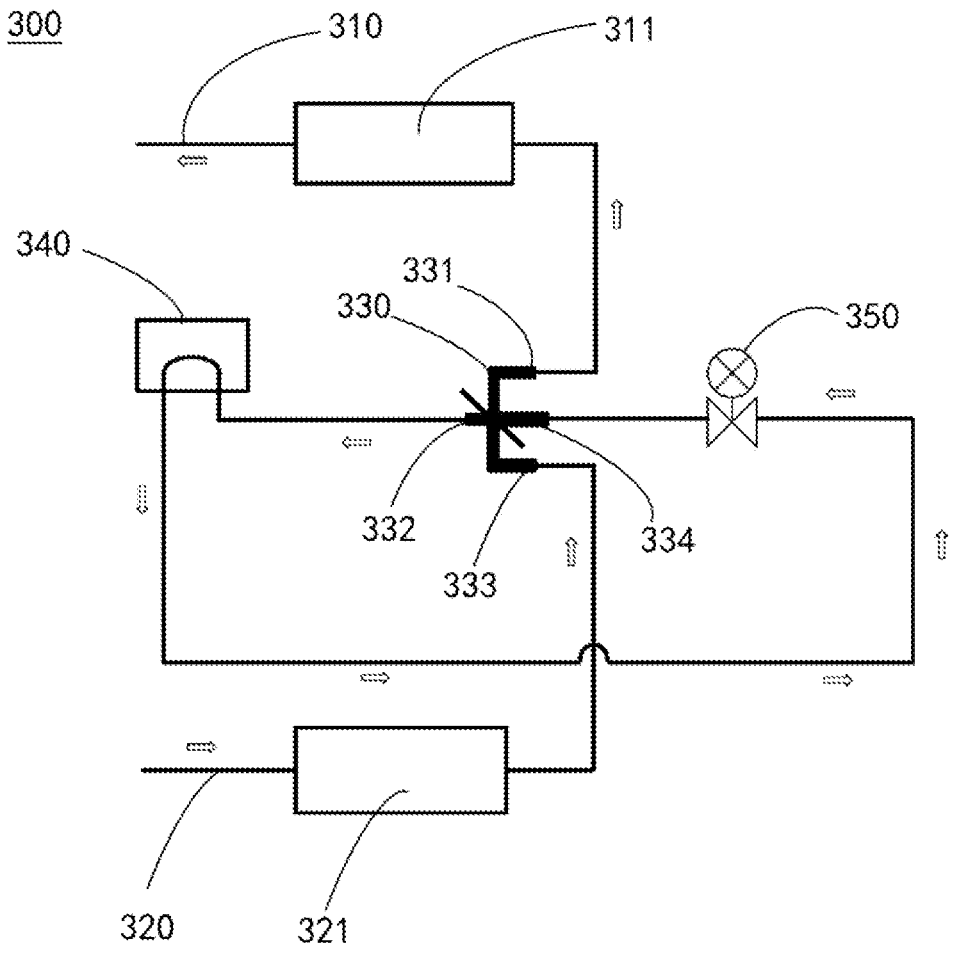
FIG. 6 shows a local schematic diagram of a third embodiment of a heat pump system according to the present invention in a heating mode.

In some embodiments, the four-way valve 330 is configured to only allow refrigerant to flow from its first port 331 to its second port 332 and from its fourth port 334 to its third port 333 in the cooling mode (as shown in FIG. 5), and to only allow refrigerant to flow from its third port 333 to its second port 332 and from its fourth port 334 to its first port 331 in the heating mode (as shown in FIG. 6). In some embodiments, the throttling device 350 is an expansion valve, such as an electronic expansion valve. In some embodiments, the four-way valve 330 is a four-way stop valve, and the heat pump system further comprises a controller (not shown) for controlling the four-way valve 330, such that the first port 331 and the second port 332 of the four-way valve 330 are communicated and the third port 333 and the fourth port 334 of the four-way valve 330 are communicated in the cooling mode, and that the first port 331 and the fourth port 334 of the four-way valve 330 are communicated and the second port 332 and the third port 333 of the four-way valve 330 are communicated in the heating mode. In some embodiments, other suitable types of valves may also be used to achieve the above functions.

The heat pump system according to the embodiments of the present invention employs a four-way valve and an electronic expansion valve to realize the application of an economizer in the cooling and heating modes. Compared to existing structure with four check valves and a single expansion valve, the number of valves is reduced, in particular the number of check valves with poor stability, which improves system stability.

According to another aspect, embodiments of the present invention also provide a control method of a heat pump system, the method comprising: communicating the first port 331 and the second port 332 of the four-way valve 330, and communicating the third port 333 and the fourth port 334 of the four-way valve 330 in the cooling mode, such that refrigerant passes through the first port 331 of the four-way valve 330, the second port 332 of the four-way valve 330, the economizer 340, the throttling device 350, the fourth port 334 of the four-way valve 330, and the third port 333 of the four-way valve 330 in turn, as shown by the arrows in FIG. 5; and communicating the first port 331 and the fourth port 334 of the four-way valve 330, and communicating the second port 332 and the third port 333 of the four-way valve 330 in the heating mode, such that refrigerant passes through the third port 333 of the four-way valve 330, the second port 332 of the four-way valve 330, the economizer 340, the throttling device 350, the fourth port 334 of the four-way valve 330 and the first port 331 of the four-way valve 330 in turn, as shown by the arrows in FIG. 6. It can thus be seen that in the control method of a heat pump system according to the embodiments illustrated in FIG. 5-6, the application of an economizer in the cooling and heating modes is realized through the use of a four-way valve and a throttling device, thereby improving system efficiency and stability.

The specific embodiments of the present invention described above are merely for a clearer description of the principles of the present invention, in which individual components are clearly shown or described to make the principles of the present invention easier to understand. Various modifications or changes to the present application may be easily made by those skilled in the art without departing from the scope of the present application. It should therefore be understood that these modifications or changes shall be included within the scope of the patent protection of the present application.

What is claimed is:

1. A heat pump system, comprising:

a heat-source-side heat exchanger on a first flow path;

a user-side heat exchanger on a second flow path;

a first branch and a second branch between the first flow path and the second flow path, the first branch being provided with a three-way valve, and the second branch being provided with a first throttling device and a second throttling device, wherein the three-way valve has a first port and a second port for communicating with the first flow path and a third port for communicating with the second flow path; and a third branch connected between a first position between the first throttling device and the second throttling device and the second port of the three-way valve, where an economizer is provided on the third branch.

2. The heat pump system according to claim 1, wherein the three-way valve is configured to only allow refrigerant to flow from its first port to its second port in a cooling mode, and to only allow refrigerant to flow from its third port to its second port in a heating mode.

3. The heat pump system according to claim 1, wherein the first throttling device and the second throttling device are expansion valves.

4. The heat pump system according to claim 1, wherein the heat pump system further comprises a controller for controlling the first throttling device and the second throttling device, wherein the controller is configured to turn off the first throttling device and allow the second throttling device to throttle in the cooling mode, and to turn off the second throttling device and allow the first throttling device to throttle in the heating mode.

5. The heat pump system according to claim 4, wherein the three-way valve is a three-way stop valve, and the controller is configured to control the three-way valve such that the first and second ports of the three-way valve are turned on and the third port is turned off in the cooling mode, and that the third and second ports of the three-way valve are turned on and the first port is turned off in the heating mode.

6. A control method of a heat pump system for use in a heat pump system according to claim 1, the method comprising:

turning off the first throttling device and allowing the second throttling device to throttle in a cooling mode such that refrigerant passes through the first port of the three-way valve, the second port of the three-way valve, the economizer and the second throttling device in turn, and turning off the second throttling device and allowing the first throttling device to throttle in a heating mode such that refrigerant passes through the third port of the three-way valve, the second port of the three-way valve, the economizer and the first throttling device in turn.

7. A heat pump system, comprising:

a heat-source-side heat exchanger on a first flow path;

a user-side heat exchanger on a second flow path;

a first three-way valve and a second three-way valve arranged in parallel between the first flow path and the second flow path, wherein the first three-way valve has a first port and a second port for communicating with the first flow path and a third port for communicating with the second flow path, and the second three-way valve has a first port and a second port for communicating with the first flow path and a third port for communicating with the second flow path; and an economizer and a throttling device connected in turn between the second port of the first three-way valve and the second port of the second three-way valve, wherein the economizer and the throttling device are operably connected between the heat-source-side heat exchanger and the user-side heat exchanger.

8. The heat pump system according to claim 7, wherein the first three-way valve is configured to only allow refrigerant to flow from its first port to its second port in a cooling mode and to only allow refrigerant to flow from its third port to its second port in a heating mode.

9. The heat pump system according to claim 7, wherein the throttling device is an expansion valve.

10. The heat pump system according to claim 7, wherein the first three-way valve is a first three-way stop valve and the second three-way valve is a second three-way stop valve, wherein the heat pump system further comprises a controller for controlling the first three-way valve and the second three-way valve, such that the first and second ports of the first three-way valve are turned on and the third port of the first three-way valve is turned off, and the second and third ports of the second three-way valve are turned on and the first port of the second three-way valve is turned off in the cooling mode, and that the second and third ports of the first three-way valve are turned on and the first port of the first three-way valve is turned off, and the first and second ports of the second three-way valve are turned on and the third port of the second three-way valve is turned off in the heating mode.

11. A control method of a heat pump system for use in a heat pump system according to claim 7, the method comprising:

turning on the first and second ports of the first three-way valve and turning off the third port of the first three-way valve, and turning on the second and third ports of the second three-way valve and turning off the first port of the second three-way valve in the cooling mode, such that refrigerant passes through the first port of the first three-way valve, the second port of the first three-way valve, the economizer, the throttling device, the second port of the second three-way valve and the third port of the second three-way valve in turn; and turning on the second and third ports of the first three-way valve and turning off the first port of the first three-way valve, and turning on the first and second ports of the second three-way valve and turning off the third port of the second three-way valve in the heating mode, such that refrigerant passes through the third port of the first three-way valve, the second port of the first three-way valve, the economizer, the throttling device, the second port of the second three-way valve and the first port of the second three-way valve in turn.

12. A heat pump system, comprising:

a heat-source-side heat exchanger on a first flow path;

a user-side heat exchanger on a second flow path;

a four-way valve arranged between the first flow path and the second flow path, wherein the four-way valve has a first port and a second port for communicating with the first flow path, and a third port and a fourth port for communicating with the second flow path; and an economizer and a throttling device connected in turn between the second port and the fourth port of the four-way valve, wherein the economizer directly communicates with the second port of the four-way valve.

13. The heat pump system according to claim 12, wherein the four-way valve is configured to only allow refrigerant to flow from its first port to its second port and from its fourth port to its third port in the cooling mode, and to only allow refrigerant to flow from its third port to its second port and from its fourth port to its first port in the heating mode.

14. The heat pump system according to claim 12, wherein the throttling device is an expansion valve.

15. The heat pump system according to claim 12, wherein the four-way valve is a four-way stop valve, and the heat pump system further comprises a controller for controlling the four-way valve, such that the first and second ports of the four-way valve are communicated and the third and fourth ports of the four-way valve are communicated in the cooling mode, and that the first and fourth ports of the four-way valve are communicated and the second and third ports of the four-way valve are communicated in the heating mode.

16. A control method of a heat pump system for use in a heat pump system according to claim 12, the method comprising:

communicating the first and second ports of the four-way valve and communicating the third and fourth ports of the four-way valve in a cooling mode, such that refrigerant passes through the first port of the four-way valve, the second port of the four-way valve, the economizer, the throttling device, the fourth port of the four-way valve and the third port of the four-way valve in turn; and communicating the first and fourth ports of the four-way valve and communicating the second and third ports of the four-way valve in a heating mode, such that refrigerant passes through the third port of the four-way valve, the second port of the four-way valve, the economizer, the throttling device, the fourth port of the four-way valve and the first port of the four-way valve in turn.

17. The heat pump system according to claim 8, wherein the second three-way valve is configured to only allow refrigerant to flow from its second port to its third port in the cooling mode and to only allow refrigerant to flow from its second port to its first port in the heating mode.

* * * * *